United States Patent [19]

Hacker

[11] 4,279,111

[45] Jul. 21, 1981

[54] RETAINING CLIP FOR SOFFIT FIXING ON STEEL BEAMS OR COLUMNS

[75] Inventor: Dennis J. Hacker, Albuquerque, N. Mex.

[73] Assignee: High Efficiency Insulation Technologies, Inc., Albuquerque, N. Mex.

[21] Appl. No.: 62,246

[22] Filed: Jul. 30, 1979

Related U.S. Application Data

[63] Continuation-in-part of Ser. No. 823,217, Aug. 10, 1977, abandoned.

[51] Int. Cl.[3] ..... E04B 1/38

[52] U.S. Cl. ..... 52/714; 52/715; 52/727

[58] Field of Search ..... 52/714, 715, 727, 361, 52/362, 363, DIG. 8

[56] References Cited

U.S. PATENT DOCUMENTS

| | | | |
|---|---|---|---|
| 2,008,192 | 7/1935 | Stubbs | 52/361 X |
| 2,021,908 | 11/1935 | Bockman | 52/361 X |
| 2,129,975 | 9/1938 | Urbain | 52/361 X |
| 4,000,596 | 1/1977 | Magill et al. | 52/714 X |
| 4,043,092 | 8/1977 | Paul et al. | 52/727 X |
| 4,052,831 | 10/1977 | Roberts et al. | 52/391 X |

FOREIGN PATENT DOCUMENTS

| | | | |
|---|---|---|---|
| 707473 | 4/1965 | Canada | 52/714 |

*Primary Examiner*—Carl D. Friedman
*Attorney, Agent, or Firm*—Frank P. Cyr

[57] ABSTRACT

A clip for holding an insulating and/or fireproofing panel to the surface of a structural member such as an I-beam or the like. The panel may be coated on one side thereof with a suitable adhesive and the clip will assist in supporting the panel in intimate contact with the surface of the structural member during the setting or hardening of the adhesive. In instances where the panel is left uncoated with an adhesive, the clip is strategically spaced along the length of the structural member to maintain the panel in close contact with the structural member.

1 Claim, 6 Drawing Figures

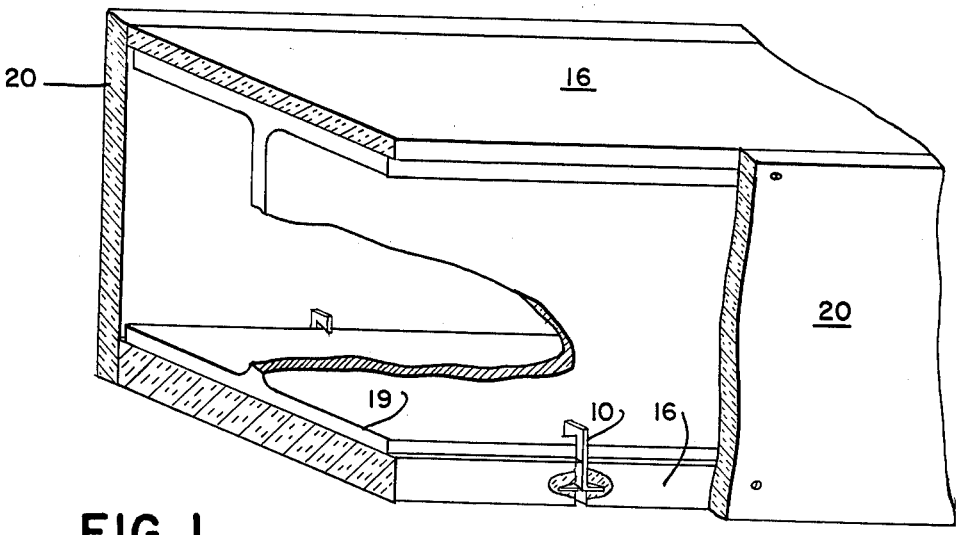
FIG. 1
FIG. 2
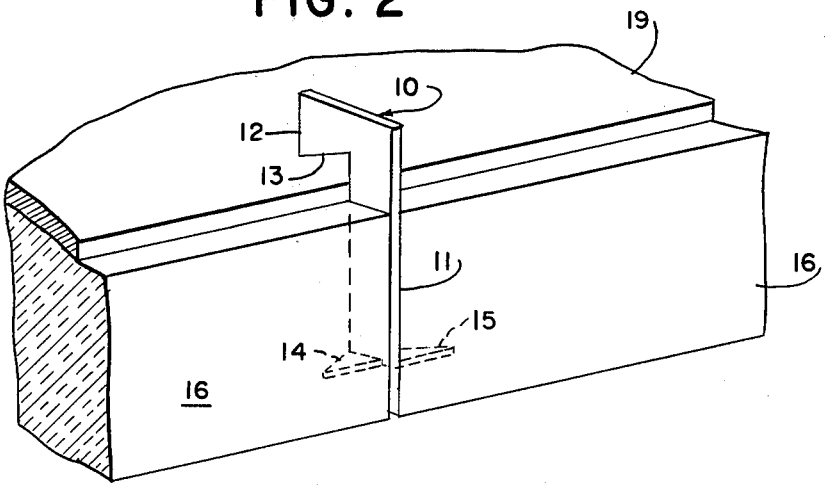

RETAINING CLIP FOR SOFFIT FIXING ON STEEL BEAMS OR COLUMNS

This is a continuation-in-part application of application Ser. No. 823,217, 8-10-77, now abandoned.

BACKGROUND OF THE INVENTION

Numerous attempts have been made to adhesively and/or otherwise secure an insulating and/or fireproofing panel to the surface of a structural member such as an I-beam but all such prior attempts have not been proven satisfactory for a variety of reasons. One such reason is that following the application of the panel to the structural member some means must be employed to retain the panel in close contact with the surface of the structural member while the adhesive sets or hardens. The setting or hardening of the adhesive can take anywhere from a few hours to possibly a day or so depending on the type of adhesive employed, temperature conditions surrounding the area where the installation is taking place, etc. Usually some type of shoring is employed to retain the panel in intimate contact with the surface of the structural member as with two by four studding or other type truss means. This, of course, is quite time consuming with no assurance that the shoring will stay in place while the adhesive is setting.

With the above in mind, one object of the invention is to utilize a clip so formed that the same will engage with the wing portions of a structural member such as an I-beam and will also engage with the insulating panel to retain the same in intimate contact with the surface of the structural member while the adhesive thereon sets or hardens.

Another object of the invention is to provide a clip for retaining a panel to the surface of a structural member where little if any heat from outside of the insulated portion of the structural member is actually transferred to the structural member.

Another object of the invention is to provide a clip for securing panels to the surface of a structural member which will permit adjoining sections of insulation and or fireproofing panels to butt against one another thus minimizing the transfer of heat from within an enclosure to the structural member to which the insulation and or fireproofing panels have been applied.

Another object of the invention is to provide a clip which may be strategically spaced along the length of a structural member and frictionally engaging the same with one end thereof whereas the other end of the clip is provided with a pair of diametrically opposed 90° angle bent portions to which the ends of the panel are impaled to thus retain the panel in close intimate contact with the said structural member.

Another object of the invention is to provide a means for securing or holding an insulating panel and or fireproofing panel to a structural member where a clip of extreme thinness is employed for engagement with the structural member and to the said panel to thereby minimize the transfer of heat and/or cold from outside the insulated and/or fireproofed structural member to the said structural member.

Other objects and advantages of the invention will become apparent by reference to the detailed description thereof and the accompanying drawings illustrating a preferred embodiment of the invention.

DESCRIPTION OF THE DRAWINGS

FIG. 1 is a perspective view of a section of the assembly, with parts broken away.

FIG. 2 is an enlarged front elevation with parts broken away.

DESCRIPTION OF THE PREFERRED EMBODIMENTS

Figure 3:
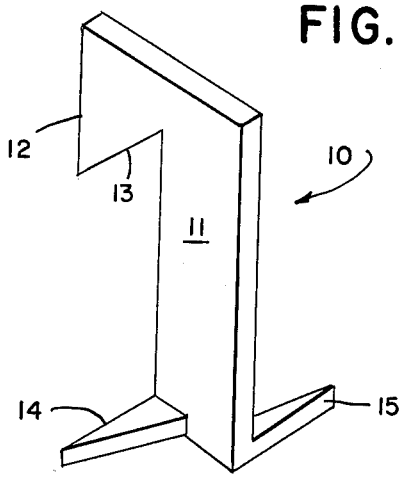
FIG. 3 is a perspective view of the clip of the present invention.
Figure 6:
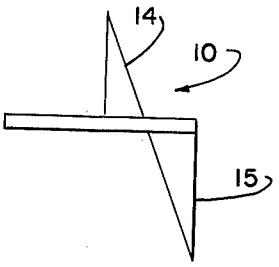
FIG. 6 is a top plan view of the clip shown in FIG. 3 of the drawings.

Before undertaking a detailed description of the present invention, it is pointed out that the clip of the present invention is intended primarily for retaining an adhesively coated insulating and/or fireproofing panel to the surface of a structural member such as an I-beam or the like and to retain the same in intimate contact with the surface of the structural member while the adhesive on the panel sets or hardens.

In instances where no adhesive is applied to one face of the panel, the clip may be strategically spaced along the length of the structural member to thus maintain the panels in close intimate contact with the surface of the structural member in a manner to be more fully described hereinafter.

Referring now to the drawings wherein like reference numerals are employed to designate like parts throughout the several views thereof, numeral 10 designates in general the clip of the present invention. The clip may be constructed of any metallic material or from a suitable plastic material and the same may be made in any number of ways such as by stamping, casting, molding or the like.

Figure 5:
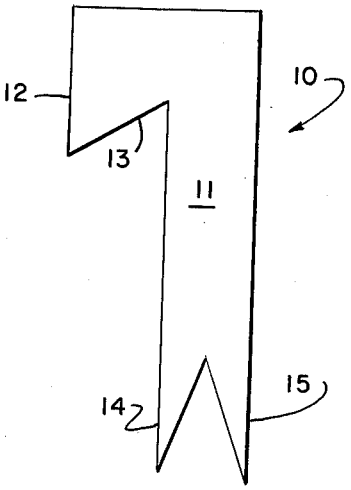
FIG. 5 is a side elevation of the clip of the present invention.
Figure 4:
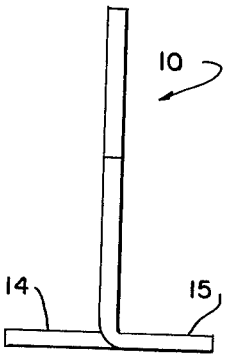
FIG. 4 is a front elevation of the clip shown in FIG. 3.

As shown more clearly in FIG. 5 of the drawings, the clip comprises a relatively thin body portion 11 which forms one leg of a generally seven-shaped structure. A shorter leg portion 12 of the clip is formed integral with the main body 11 and is provided at the outer end thereof with a tapered portion 13 for a purpose to be described more fully hereinafter. The main body 11 of the clip is provided at the lower end thereof with a pair of tapered projections 14, 15 which extend in the same plane as the main body 11 prior to usage of the clip in the manner to be more fully described hereinafter.

An insulation and/or fireproofing panel 16 is in the form of a flat sheet of material composed of the insulation and/or fireproofing composition set forth in my applications for patent, Ser. Nos. 828,416, filed Aug. 29, 1977, and 831,687, filed Sept. 8, 1977. While I have shown the panel as being flat in configuration, it will be understood the panel may be formed of a configuration which will adapt the same to be applied to a surface other than a flat surface to insulate and/or fireproof the same. However, as stated previously, the clip of the present invention is adapted primarily to retain a flat sheet of insulation and/or fireproofing material to a relatively flat surface.

Referring again to FIGS. 3 to 6 inclusive of the drawings, the clip 10 is formed of a relatively thin material having the required tensile strength to support the panels when in use.

The tapered portion 13 of the short leg of the figure seven of the main body 11 tapers inwardly from the outermost end portion of the short leg towards the main body 11 and extends in the same plane as the main body 11.

The structural member in the nature of an I-beam 18 is provided with the usual wing portions 19 extending radially outwardly from the center or central web of the beam.

In one manner of securing the insulating and/or fireproofing panel 16 to the surface of the structural member 18, a coating of a suitable adhesive is applied to one surface of the panel and the surface of the beam 18 is cleansed of any foreign material which could otherwise impede the adherence of the adhesive thereto and a clip constructed as described above is mounted on the wing 19 of the beam. The pointed end 17 of the leg 12 of the clip will frictionally engage with the surface of the aforesaid wing to retain the same thereon. Prior to the application of the clip to the wing, as aforesaid, the tapered sections 14, 15 will have been oppositely bent to a 90° angle with respect to the main body 11 of the clip such as shown more clearly in FIGS. 3, 4 and 6 of the drawings. With the clip mounted on the wing, as aforesaid, a panel having the adhesive coated thereon is then impaled on one of said projections and as shown in the drawings, there is a clip for both sides of the beam. Thus, one edge of the panel will have been fixed to the clip and when this has been accomplished the other end of the panel is likewise impaled on one of the tapered projections of the next adjacent clip thus supporting the panel on the surface of the beam. It will be noted that the tapered projections of the clip are embedded in the insulating material thus avoiding any heat transfer from the exterior of the panel to the surface of the structural member. This can best be seen in the broken away view of FIG. 1 of the drawings. The panels thus supported by the aforesaid clips will substantially abut one another, the only spacing between adjoining panels being the thickness of the main body 11 of the clip. It is for this reason that the clip should be thin as possible but still having the required tensile strength to support the aforesaid panels.

If an uncoated panel is to be supported to a structural member in the manner previously described, the clips are again mounted on the wing of the structural member in the manner aforesaid and the tapered sections 14, 15 are oppositely bent to a 90° angle with respect to the main body 11 of the clip as shown in the drawings. The ends of the panel are then impaled on the tapered sections 14, 15 in the manner previously described.

The manner of securing an uncoated panel to a structural member as set forth above is more feasible where relatively short lengths of panels are to be supported on the structural member. Since there is no adhesive on one side of the panel to assist in retaining the panel in close contact with the surface of the structural member, the entire weight of the panel must be supported solely by the aforesaid clips and this would not be desirable where a panel of great length is to be supported to the surface of a structural member.

While I have shown and described the employment of the clip in association with an I-beam, it is obvious the clip may be employed in conjunction with other type structural members, the only requirement being that the structural member be provided with a wing-like portion thereon for engagement therewith of the tapered projection of the clip.

In instances where it is desirable to completely encase the structural member with the insulating and/or fireproofing panels, a panel having an adhesive coating thereon can be applied to the upper surface of the beam as shown in FIG. 1 of the drawings and by securing to both the upper and lower panels, side members also of insulating and/or fireproofing material in the form of panels 20 can be nailed or otherwise secured to the aforesaid upper and lower panels. However, the crux of the present invention resides in the structure of the clip previously described and the manner of use thereof also as previously set forth above.

It is to be understood that the above described arrangement is simply illustrative of the application of the principles of this invention. Numerous other arrangements may be readily devised by those skilled in the art which will embody the principles of the invention and fall within the spirit and scope thereof.

What is claimed is:

1. A device for supporting an insulation panel having an adhesive surface on one side thereof to the under side of a structural member comprising a clip having a main body with an angularly related tapered portion formed on one end thereof for engagement with the web of a structural member, said tapered portion lying in the same plane as the said body and tapering toward said body, a pair of tapered tail portions at the opposite end of said main body adapted to be oppositely bent to a 90° angle with respect to said body to which the ends of an insulating panel may be impaled and retained thereon thus allowing the said adhesive to harden and to retain the said panel to the said undersurface of said structural member.

* * * * *